US009278421B2

(12) United States Patent
Diehl et al.

(10) Patent No.: US 9,278,421 B2
(45) Date of Patent: Mar. 8, 2016

(54) METHOD FOR GRINDING WORKPIECES, IN PARTICULAR FOR CENTERING GRINDING OF WORKPIECES SUCH AS OPTICAL LENSES

(71) Applicant: Satisloh AG, Baar (CH)

(72) Inventors: Joachim Diehl, Giessen (DE); Steffen Moos, Wettenberg (DE); Achim Schmidt, Lahnau (DE)

(73) Assignee: Satisloh AG, Baar (CH)

( * ) Notice: Subject to any disclaimer, the term of this patent is extended or adjusted under 35 U.S.C. 154(b) by 0 days.

(21) Appl. No.: 14/402,374

(22) PCT Filed: Apr. 25, 2013

(86) PCT No.: PCT/EP2013/001240
§ 371 (c)(1),
(2) Date: Nov. 20, 2014

(87) PCT Pub. No.: WO2013/174468
PCT Pub. Date: Nov. 28, 2013

(65) Prior Publication Data

US 2015/0093967 A1 Apr. 2, 2015

(30) Foreign Application Priority Data

May 22, 2012 (DE) ..... 10 2012 010 004

(51) Int. Cl.
*B24B 9/14* (2006.01)
*B24B 9/06* (2006.01)
*B24B 9/08* (2006.01)

(52) U.S. Cl.
CPC ..... *B24B 9/148* (2013.01); *B24B 9/065* (2013.01); *B24B 9/085* (2013.01)

(58) Field of Classification Search
CPC ..... B24B 9/148; B24B 9/065
USPC ..... 451/5
See application file for complete search history.

(56) References Cited

U.S. PATENT DOCUMENTS 4,428,162 A 1/1984 Feldt et al.
4,884,373 A 12/1989 Suzuki et al.
(Continued)

FOREIGN PATENT DOCUMENTS

EP 1 693 151 A2 1/2006

OTHER PUBLICATIONS

PCT International Preliminary Report on Patentability, Application No. PCT/EP2013/001240, Filing Date—Apr. 25, 2013, Mailing Date—Nov. 25, 2014, 6 pages (English).
(Continued)

*Primary Examiner* — Lee D Wilson
*Assistant Examiner* — Henry Hong
(74) *Attorney, Agent, or Firm* — Reising Ethington P.C.

(57) ABSTRACT

The invention relates to a method for centering grinding of workpieces, for example optical lenses by a grinding tool using an actuator for generating an advancing movement between the grinding tool and the workpiece, wherein the actuator and a current regulator for an actuator current which determines an advancing force of the actuator are integrated in a position control loop using a predetermined control cycle. For each control cycle: (i) a desired direction of movement ($R_{soll(n)}$) of the advancing movement and an actual direction of movement ($R_{ist(n)}$) of the advancing movement are ascertained; then (ii) the ascertained actual and desired directions of movement are compared to one another; and (iii) when the comparison results in a deviation between the actual and desired directions of movement, a predetermined current limit ($I_{sollmax}$) for the actuator current emitted via the current regulator is decreased in a defined manner.

12 Claims, 3 Drawing Sheets

(56) References Cited

U.S. PATENT DOCUMENTS

| | | | | |
|---|---|---|---|---|
| 5,804,940 | A | 9/1998 | Erkens et al. | |
| 6,325,700 | B1 * | 12/2001 | Mizuno | B23Q 3/18 451/384 |
| 6,354,907 | B1 | 3/2002 | Satoh et al. | |
| 7,413,499 | B2 | 8/2008 | Noda | |
| 7,731,565 | B2 * | 6/2010 | Shibata | B24B 9/14 451/42 |
| 2006/0073765 | A1 * | 4/2006 | Noda | B24B 7/00 451/5 |
| 2006/0264154 | A1 * | 11/2006 | Mizuno | B24B 47/225 451/5 |
| 2008/0248722 | A1 * | 10/2008 | Takeichi | B24B 9/148 451/5 |
| 2010/0167627 | A1 * | 7/2010 | Kamiya | B24B 37/005 451/5 |
| 2010/0197198 | A1 * | 8/2010 | Takeichi | B24B 9/148 451/5 |
| 2012/0220194 | A1 * | 8/2012 | Maloney | B24B 27/0038 451/5 |
| 2013/0090038 | A1 * | 4/2013 | Duescher | B24B 49/00 451/5 |
| 2013/0316624 | A1 | 11/2013 | Diehl et al. | |

OTHER PUBLICATIONS

Werkzeugmaschinen Band 3, Automatisierung and Steuerruhgstechnik, Prof. Dr.-Ing. Manfred Weck,VDI Verlag GmbH, Dusseldorf, 1989, 5 pages.

PCT International Search Report and Written Opinion, Application No. PCT/EP2013/001240, Filing Date—Apr. 25, 2013, Mailing Date—Jun. 24, 2014, 9 pages (in German).

* cited by examiner

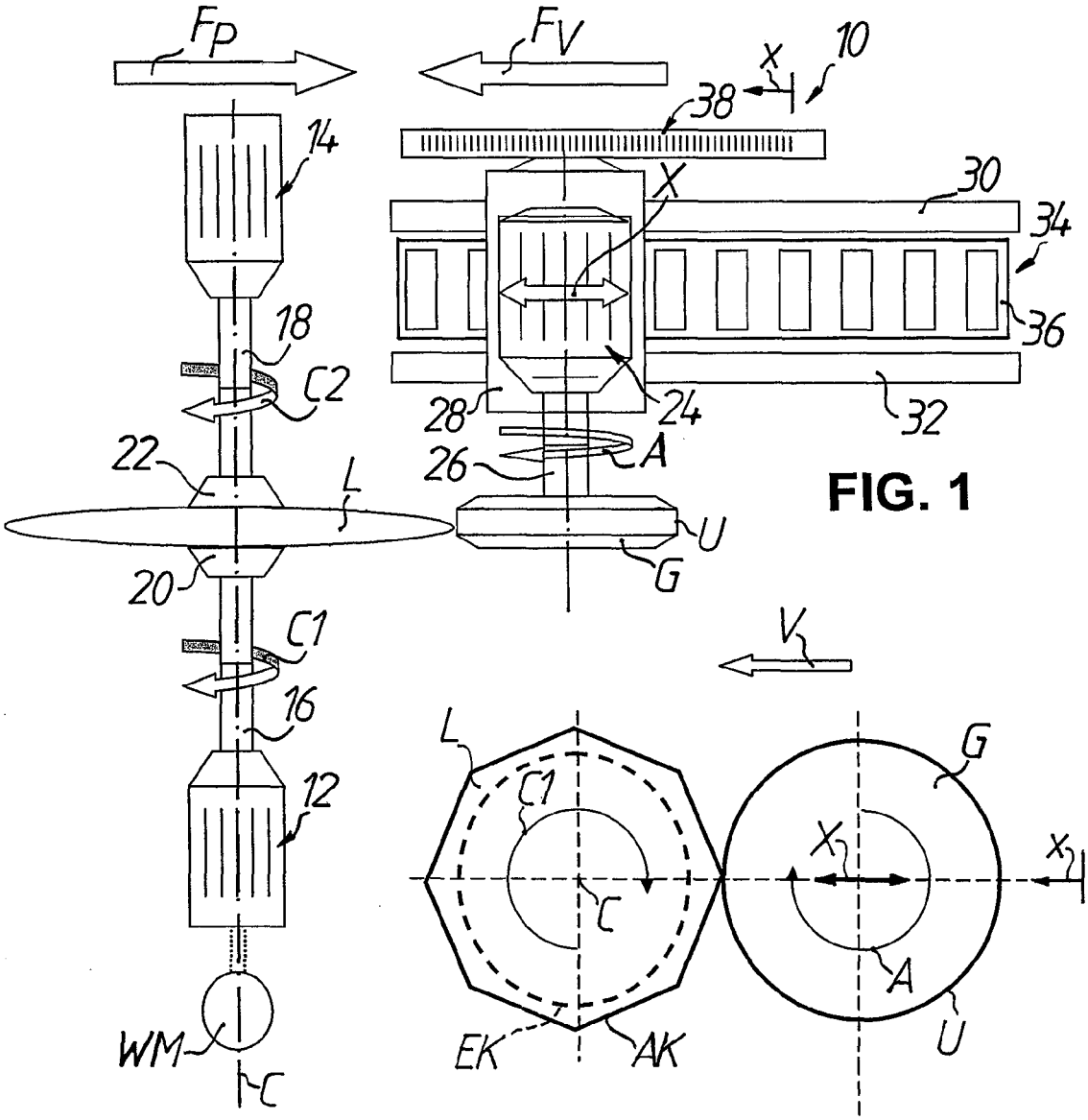
FIG. 1
FIG. 2
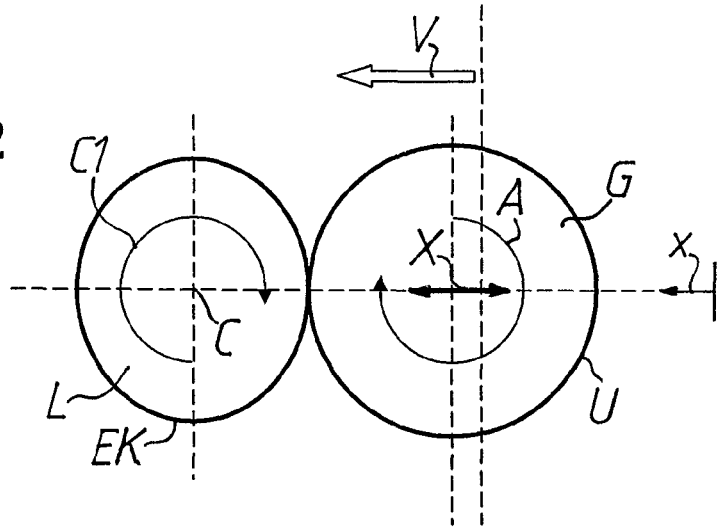

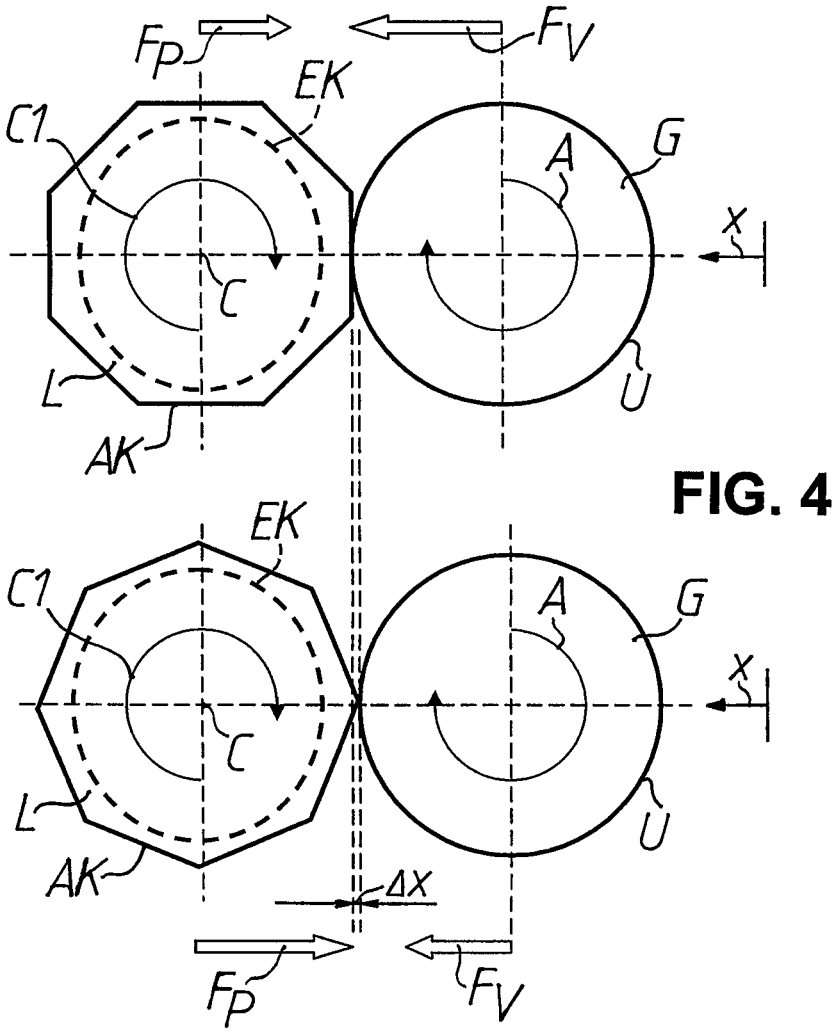
FIG. 4
FIG. 5
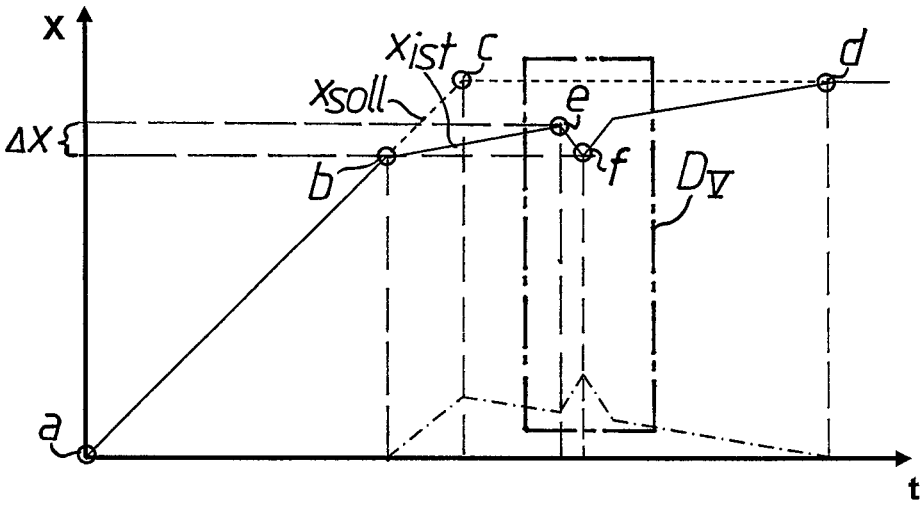

METHOD FOR GRINDING WORKPIECES, IN PARTICULAR FOR CENTERING GRINDING OF WORKPIECES SUCH AS OPTICAL LENSES

TECHNICAL FIELD

The present invention relates generally to a method of grinding workpieces by a grinding tool with use of an actuator for producing a relative advancing movement between grinding tool and workpiece, wherein the actuator together with a current controller for an actuator current, which determines an advance force of the actuator, is integrated in a position control circuit which is run through with a predetermined control cycle.

In particular, the invention relates to a method for centered grinding of workpieces from the fields of use of high-precision optics (optical glasses), horological industry (timepiece glasses) and semiconductor industry (wafers), where workpieces are initially to be subject to centered clamping by centering machines and subsequently ground at the edge.

PRIOR ART

Lenses for objectives or the like are, after processing of the optical surfaces, "centered" so that the optical axis, the position of which is characterized by a straight line running through the two points of curvature of the optical surfaces, also passes through the geometric centre center of the lens. The lens is for this purpose initially so aligned and clamped between two aligned centering spindles that the two center points of curvature of the lens coincide with the common axis of rotation of the centering spindle. The edge of the lens is subsequently processed in such a defined relationship to the optical axis of the lens as is later necessary for fitting the lens in a frame. In that case the edge is provided with a defined geometry both in plan view of the lens, i.e. circumferential profile of the lens, and as seen in radial section, i.e. profile of the edge, for example rectilinear formation or formation with a step or steps/facet or facets, by machining. This is carried out, in particular in the case of glass lenses, by a grinding process. If in connection with the present invention reference is generally made to "grinding", this, however, also embraces "finish-grinding" and "polishing", where processing is similarly by geometrically indeterminate cutting.

Sofar as the mechanisms, which are used in centering, for producing the relative advancing movement between grinding tool and workpiece are concerned, in the case of the older cam-controlled centering machines "LZ 80" of LOH Optikmaschinen AG, Wetzlar, Germany (predecessor in law of Satisloh GmbH), the two grinding spindles for the rotary drive of the grinding tools (grinding wheels) were adjusted with the use of settable weights by way of a cable pull. The maximum adjusting movement of the grinding spindles themselves was in that regard controlled by way of slowly rotating cam discs on which a scanning roller, coupled with the respective grinding spindle, ran as a fixed stop. Although this very simple mechanical solution had advantages with respect to the processing speed possible, because the advance largely set itself in dependence on the capability of the grinding wheels and the ground substrate material itself, there was the serious disadvantage that an individual cam disc had to be provided for every workpiece geometry.

Solutions are also known (see, for example, specification EP-A-1 693 151, which does not, however, relate to a centering machine) in which the grinding force is set by way of the bias of springs acting on the grinding spindle. However, the use of springs for setting the grinding force has disadvantages when grinding of non-circular, in particular polygonal, geometries of rotating workpieces is involved. In particular, at the corners the workpiece "strives" to urge the grinding disc away against the direction of advance, in which case the bias of the springs acting on the grinding spindle increases. This in turn produces an undesired increase in the grinding force, which can have the consequence of a trough, thus a shape fault, arising in the region of the corners of the workpiece pressing on the grinding wheel.

In modern CNC-controlled centering machines, which by way of appropriate track guidance of tool and/or workpiece enable grinding of any workpiece shapes, a constrained advance control is usually provided. However, if in that case the speed of advance is selected to be too rapid, overloading of the grinding tool and, in certain circumstances, also "burning" of the workpiece at the point of contact between tool and workpiece can occur, which can lead to resonances and significant consequential damage to, among other parts, the centering machine particularly when mineral oil is used as cooling lubricant. Programmed safety spacings can indeed provide a remedy here, for example in such a manner that the speed of advance is set to be high up to a predetermined spacing between tool and workpiece and, when this spacing is reached, is switched over to a lower speed of advance. However, such safety mechanisms necessarily occasion longer processing times.

Finally, so-called "adaptive control" solutions are also known (see, for example, specification U.S. Pat. No. 7,413,499) in which the power consumption of the grinding spindle and/or the rotary drive for the workpiece or, however, signals from specifically provided force-pick-ups are used as input variables for limitation of advance. A disadvantage of control of advance in dependence on power consumption of the grinding spindle is that, due to the high cutting speeds required for the grinding, the latter is sluggish as a consequence of the mass inertia of grinding spindle and grinding tool and therefore reacts only with a delay, possibly too late. Conversely, the use of a force sensor has, in particular, the disadvantage that this always has to be arranged between tool and machine or workpiece and machine, which as a consequence of function leads to a degree of pliancy of the machine, which can be detrimental to high workpiece quality and accuracy.

What is desired is to provide a method of grinding workpieces, particularly for centered grinding of workpieces such as optical lenses, which addresses the problems discussed above with respect to the prior art. In particular, in that regard the advancing movement between grinding tool and workpiece shall be such that on the one hand during grinding neither overloading of the grinding tool nor "burning" or faulty shaping of the workpiece occurs or arises and on the other hand the speed of advance and material machining are nevertheless carried out rapidly and efficiently as possible.

SUMMARY OF THE INVENTION

According to invention in a method for grinding workpieces, particularly for centered grinding of workpieces such as optical lenses, by a grinding tool with use of an actuator for producing a relative advancing movement between grinding tool and workpiece, which actuator is integrated together with a current controller for an actuator current, which determines an advance force of the actuator, in a position control circuit which is run through with a predetermined control cycle, for each control circuit initially: (i) a target movement direction of the advancing movement and an actual movement direction of the advancing movement are determined; then (ii) the determined actual movement direction of the advancing movement is compared with the determined target movement direction of the advancing movement; and finally (iii) if the comparison shows a difference between the actual movement direction of the advancing movement and the target movement direction of the advancing movement a predetermined current limit for the actuator current delivered by way of the current controller is reduced in defined manner in order to reduce the advance force of the actuator.

Through this method—in which a variable advance force is preset for the advancing motor (actuator) by way of the motor current, a conclusion about the instantaneous force relationships is made on the basis of the target and actual directions of the advancing movement and as a result thereof the advance force is influenced by way of the motor current in dependence on the process—there is optimization of, in particular, the machining capability during grinding, especially in the centering of non-circular workpieces. By comparison with the prior art the result is significant reductions in processing times, elimination of safety spacings, simple recognition of cutting start and reliable prevention of overload states of tool and workpiece due to excessive speeds of advance or due to collisions. The actual speed of advance is here ultimately determined by way of the machining capability of the tool, which can change during the course of processing due to, for example, blunting or clogging of the abrasive coating or a change in the coolant and lubricant capabilities. Ultimately, external force pick-ups or the like are rendered superfluous through the evaluation of the target and actual directions of the advancing movement and the utilization of the force/current dependence of the advancing motor; pliancies which may be detrimental to workpiece quality and accuracy are thus avoided.

For preference, for ascertaining or determining the movement directions of the advancing movement in the above step (i) the target and actual positions of the actuator are evaluated from the present control cycle and from the preceding control cycle, which can be derived without problems from the position control circuit.

With respect to a good possibility of influencing the behavior of the change in current it is additionally preferred if in the comparison of the determined actual movement direction of the advancing movement and the determined target movement direction of the advancing movement in the above step (ii) a comparison signal is generated which produces a current reduction signal by way of a PI or PID transfer element, wherein in the step (iii) a signal for the predetermined current limit reduced by the respective current reduction signal is then applied to the current controller as current limitation signal.

In order to optimize the grinding method for the processing of non-circular geometries, which can be "polygonal" to a greater or lesser extent, use is preferably made of different parameter sets for the proportional component (amplification $K_P$) and the integral component (reset time $T_N$) of the PI or PID transfer element in dependence on the shape of the workpiece to be ground.

Although any actuators can be used as advancing drive for the grinding method according to the invention, provided these have a defined force/current dependence, it is ultimately preferred, particularly with respect to a high level of sensitivity of the regulation, a rapid reaction behavior, an easy motion and freedom from self-locking, etc., if a linear motor is used as the actuator for producing the relative advancing movement between grinding tool and workpiece.

BRIEF DESCRIPTION OF THE DRAWINGS

The invention is explained in more detail in the following on the basis of a preferred embodiment with reference to the accompanying, simplified drawings, in which:

FIG. 1 shows a front view of a centering machine, which is illustrated merely schematically, for, in particular, optical lenses, in which the grinding method according to the invention can be employed;

FIG. 2 shows an illustration of the principle with respect to a centered grinding process, wherein the start of the actual grinding is shown in the upper part of the figure and the end of the actual grinding is shown in the lower part of the figure;

FIG. 4 shows an illustration of the principle with respect to a centered grinding process with a procedure according to the invention—performed on a workpiece with a non-circular external profile—for clarification of the change in the process force component, which opposes the advance force, as a consequence of the spacing, which changes in dependence on rotational angle, of the point of action between grinding tool and workpiece relative to the workpiece axis of rotation and the then correspondingly reduced advance force; and FIG. 5 shows a diagram in which by way of example the advance travel x (at the top) and the lag error permitted as a consequence of the limitation of the actuator current (at the bottom) are recorded over time t for a centered grinding process with a procedure according to the invention.

DETAILED DESCRIPTION OF THE EMBODIMENT

Figure 3:
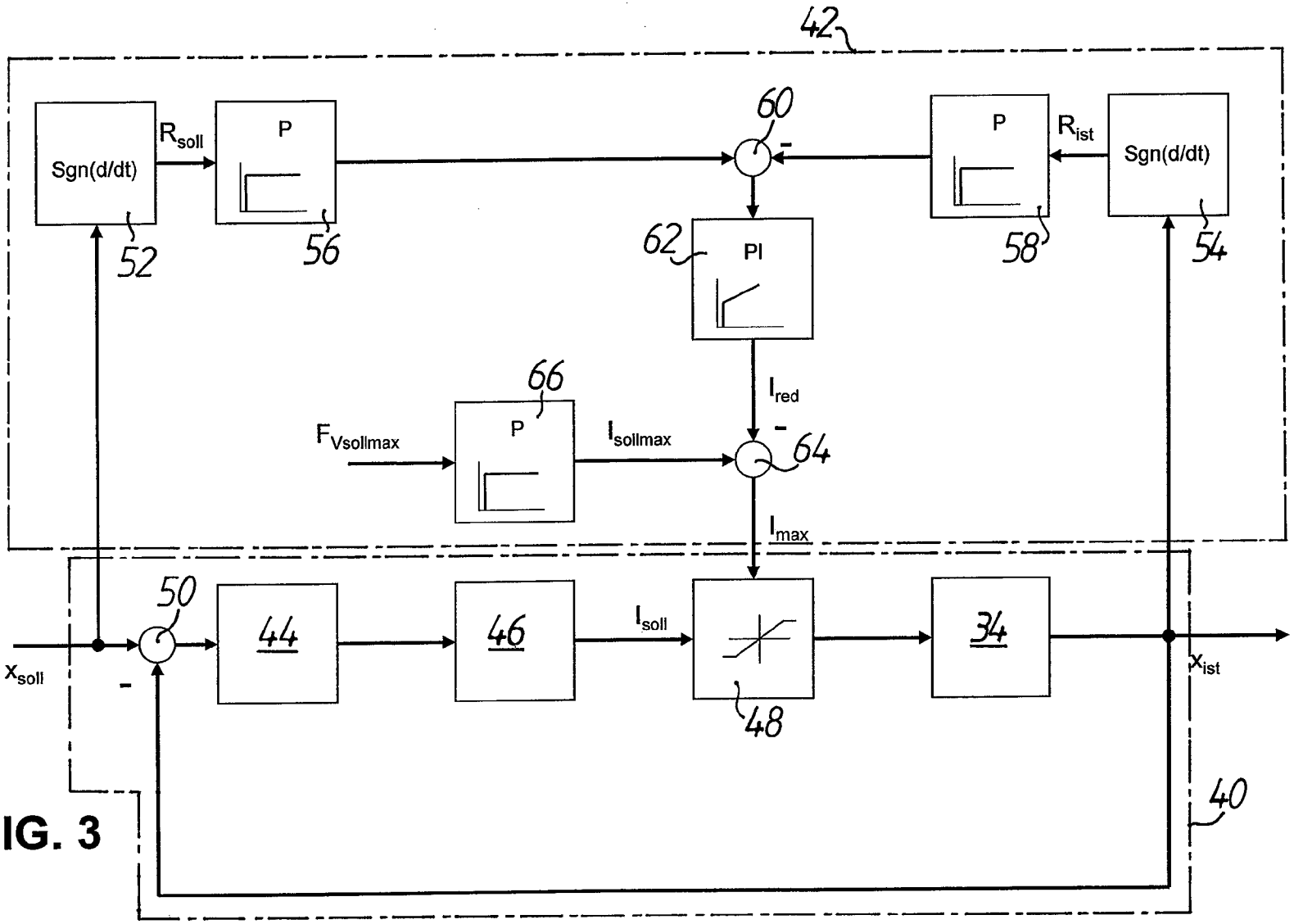
FIG. 3 shows a simplified block circuit diagram of a position control circuit for an advancing drive of the centering machine according to FIG. 1, with superordinate current control or current limitation for performance of the grinding method according to the invention.

A CNC-controlled centering machine 10 for grinding workpieces, particularly optical lenses L, is illustrated in FIG. 1 merely schematically and only to the extent that appears necessary for an understanding of the present invention. Further details with respect to the construction and functioning of the centering machine 10 can be inferred from U.S. Publication 2013/0316624 A1, to which an incorporation by reference is hereby expressly made.

In FIG. 1 there can be seen on the left two centering spindles 12, 14, which are arranged in alignment with respect to a centering axis C and the centering spindle shafts 16, 18 of which are rotationally drivable independently of one another and with positional regulation with respect to rotational angle (workpiece axes of rotation C1, C2). Synchronism of the centering spindle shafts 16, 18 is in that case by CNC technology in a manner known per se. The centering spindle shafts 16, 18 are respectively constructed at mutually facing ends for mounting a clamping bell 20, 22 such as known from German Standard DIN 58736-3. The optical lens L is firmly clamped in place between the clamping bells 20, 22 for grinding of its edge. The stroke and clamping devices, which are required for that purpose and which enable a defined movement of or force application to one of the centering spindles 12, 14 along the centering axis C, are not shown in FIG. 1. The centering spindles 12, 14 are fixed, i.e. immovable, in a direction perpendicular to the centering axis C.

Provided at the tool side is a (at least one) tool spindle 24 with a rotary drive for a tool spindle shaft 26 at which a grinding wheel G as grinding tool is mounted. The grinding wheel G is thus rotationally drivable with controlled rotational speed in correspondence with the arrow in FIG. 1 (tool axis of rotation A) in order to effect, by its circumferential surface U, material removal from the workpiece L.

The tool spindle 24 is additionally mounted on an X slide 28 which is linearly movable to the right or left in FIG. 1 under CNC positional regulation (linear axis X; advancing movement). For that purpose the X slide 28 is guided by way of guide carriages (not shown here) at two parallel extending guide rails 30, 32 mounted on a machine bed (not illustrated). Serving for the drive of the X slide 28 is a linear motor 34 as actuator, of which in FIG. 1 the stator 36, which is fixed to the machine bed, with its magnets can be seen. The rotor (coils) of the linear motor 34 is mounted under the X slide 28 and cannot be seen in FIG. 1. Arranged above the X slide 28 in FIG. 1 is a linear travel measuring system 38 by which the axial position ($x_{ist}$) of the X slide 28 can be detected in a manner known per se.

Finally, additionally indicated in FIG. 1 above the linear travel measuring system 38 or the centering spindle 14 are, on the right, the advance force $F_V$, which acts in the direction of the centering axis C and which can be exerted by the linear motor 34 on the X slide 28, the magnitude of the force being proportional to the current I applied to the rotor of the linear motor 34, and, on the left, the processing force component $F_P$, which opposes the advance force $F_V$ along the x direction and which is dependent on the rotational speed and rotational direction of the workpiece L, the rotational speed and rotational direction of the grinding wheel G (same sense/opposite sense), the material and geometry of the workpiece L, the material, geometry and state of wear of the grinding wheel G, the cooling and lubrication (friction) at the point of action between workpiece and grinding wheel G, etc.

FIG. 2 illustrates a centered grinding process in general form; an advancing movement V of the grinding wheel G rotating about the tool axis of rotation A is produced in correspondence with the arrow by way of the linear motor 3. In that case, the X axis is to be so positionally controlled that the optical lens L, which is rotationally driven about the centering axis C (workpiece axis of rotation C1) and which can at the outset have any external profile AK (octagonal in the illustrated example), is centered with respect to a final profile EK defined by an NC program. In the case of a non-circular final profile EK, such as the slightly elliptical final profile EK shown here, the axis X of advance is additionally co-ordinated in a manner known per se with the workpiece axis C1 of rotation, for which purpose the latter is provided with a high-resolution angle measuring system WM (see FIG. 1). It is evident that the grinding wheel G in the case of non-circular processing of workpieces L cannot be continuously moved in an advancing direction, i.e. only to the left in FIG. 2, but rather—at least at the end of the processing—has to be moved back and forth along the axis X of advance in dependence on the rotational angle of the workpiece L about the centering axis C so as to be able to generate the non-circular final profile EK.

With help of a simplified block circuit diagram FIG. 3 shows the position control circuit 40 for the linear motor 34 (advancing drive) of the centering machine 10 according to FIG. 1, with which is associated a special current controlling or limiting circuit, current limitation 42 for short, for the actuator current I for performance of the grinding method according to the invention. The position control circuit 40 comprises in a manner known per se—cf., for example, the reference work "Werkzeugmaschinen Band 3, Automatisierung and Steuerungstechnik" by Prof Dr.-Ing. Manfred Weck, 3rd Edition 1989, VDI-Verlag, Dusseldorf, p. 195, FIG. 8-3 which is hereby incorporated by reference—a position controller 44, a speed controller 46, a current controller 48 and the actuator controlled thereby (the linear motor 34 in the present case) as well as in the context of positional feedback a summation point 50 for the target position $x_{soll}$ and the actual position $x_{ist}$. The linear travel measuring system 38, which supplies the actual position $x_{ist}$ is shown to no greater extent in FIG. 3 than the NC control presetting the target position $x_{soll}$. In addition, subordinate speed and current feedbacks, which can be provided within the scope of cascade regulation, are not illustrated. The position control circuit 40 is, as usual, run through with a predetermined control cycle, for example with a cycle time or scanning rate of 2 ms.

Finally, it is also to be mentioned at this point that $I_{soll}$ in the position control circuit 40 according to FIG. 3 denotes the target current preset for the current controller 48, which—optionally in accordance with current feedback—is preset in the position control circuit 40 with the objective of so controlling the linear motor that the position actual value (actual position $x_{ist}$) as control circuit output follows the position target value (target position $x_{soll}$) as control circuit input as free of error as possible. However, the actuator current I delivered by way of the current controller 48 is limited in defined manner and, in particular, with consideration even of larger lag errors, for which purpose the current limitation 42 to be described in the following is provided.

Serving as input variables for the current limitation 42 are, as apparent, the target position $x_{soll}$ predetermined by the NC control for the axis X of advance, the actual position $x_{ist}$, which is detected by the linear travel measuring system 38, of the axis X of advance and a maximum target advance force $F_{Vsollmax}$, which is similarly predetermined by the NC control and from which a pre-defined current limit $I_{sollmax}$ results, this being explained in more detail later.

The target positions $x_{soll(n)}$, $x_{soll(n-1)}$ of the linear motor 34 are evaluated in the function element 52 at the top left in FIG. 3 from the present control cycle (n) and from the preceding control cycle (n−1) by a signum function ("Sgn"). The abbreviation "d/dt" (derivation over time) in this connection stands for the following relationship:

$$d/dt=(x_{soll(n)}-x_{soll(n-1)}/(t_{(n)}-t_{(n-1)}$$

Since the scanning rate is constant, this can be simplified by $(t_{(n)}-(t_{(n-1)})$=const. to:

$$d/dt=(x_{soll(n)}-x_{soll(n-1)})$$

The result of the formed signum function is the target movement direction $R_{soll(n)}$ of the advancing movement V in the present control cycle (n). In that regard, the following three cases are possible:

1. $(x_{soll(n)}-x_{soll(n-1)})>0\rightarrow$Sgn (d/dt)=$R_{soll(n)}$=+1
2. $(x_{soll(n)}-x_{soll(n-1)})=0\rightarrow$Sgn (d/dt)=$R_{soll(n)}$=0
3. $(x_{soll(n)}-x_{soll(n-1)})<0\rightarrow$Sgn (d/dt)=$R_{soll(n)}$=−1

In analogous manner the detected actual positions $x_{ist(n)}$, $x_{ist(n-1)}$ of the linear motor 34 are evaluated in the function element 54 at the top right in FIG. 3 from the present control cycle (n) and from the preceding control cycle (n−1) by a signum function. In that case:

$$d/dt=(X_{ist(n)}-x_{ist(n-1)})/(t_{(n)}-t_{(n-1)}$$

This expression is turn simplified by $(t_{(n)}-t_{n-1})$=const. to:

$$d/dt=(x_{ist(n)}-x_{ist(n-1)})$$

Accordingly, the following three cases are possible for the actual movement direction $R_{ist(n)}$ of the advancing movement in the present control cycle (n):

i. (1) $(x_{ist(n)}-x_{ist(n-1)})>0 \rightarrow \mathrm{Sgn}\ (d/dt)=R_{ist(n)}=+1$ ii. (2) $(x_{ist(n)}-x_{ist(n-1)})=0 \rightarrow \mathrm{Sgn}\ (d/dt)=R_{ist(n)}=0$ iii. (3) $(x_{ist(n)}-x_{ist(n-1)})<0 \rightarrow \mathrm{Sgn}\ (d/dt)=R_{istl(n)}=-1$ In other words, in the first case (1) there is tendency to forward movement of the grinding disc G with respect to the centering axis C, in the second case (2) the spacing of the grinding disc G from the centering axis C does not change, i.e. the grinding disc G is stationary (no movement), and in the third case (3) there is tendency to rearward movement of the grinding disc G with respect to the centering axis C.

The thus-determined directional values (1, 0 or −1) for the target movement direction $R_{soll}$ and the actual movement direction $R_{ist}$ of the advancing movement V are then respectively applied to a proportionally acting transfer element (P element) 56 or 58, which issues the respective signal with a settable amplification. This amplification can be varied in order to weight the influence of the respective signal.

The signals amplified in that manner for the target movement direction $R_{soll}$ and the actual movement direction $R_{ist}$ of the advancing movement V are thereafter applied to a summation point 60, which carries out comparison of the determined actual movement direction $R_{ist}$ of the advancing movement V with the determined target movement direction $R_{soll}$ of the advancing movement V by a difference formation (target value minus actual value). If in that case the determined target and actual movement directions $R_{soll}$ and $R_{ist}$, respectively, of the advancing movement V correspond—

$$R_{soll(n)}=+1=R_{ist(n)} \quad (a)$$

or $$R_{soll(n)}=-1=R_{ist(n)} \quad (b)$$

i.e. (a) the grinding wheel G shall have a tendency to forward movement with respect to the centering axis C and actually also moves forwardly or (b) the grinding wheel G shall have a tendency to rearward movement with respect to the centering axis C and in fact also moves rearwardly, then the output of the summation point 60 is equal to zero. The same also applies to the boundary case of the intentionally stationary axis X of advance—

$$R_{soll(n)}=0=R_{ist(n)} \quad (c)$$

i.e. if (c) no advancing movement V of the grinding wheel G is to take place and in addition is not present. The grinding process in these cases runs as desired; the grinding wheel G is sharp.

The possible difference cases in the afore-described comparison at the summation point 60 comprise, in particular, the states:

$$R_{soll(n)}=+1 \neq R_{ist(n)}=0 \quad (d)$$

and $$R_{soll(n)}=+1 \neq R_{ist(n)}=-1 \quad (e)$$

In the first-mentioned difference case (d) the grinding wheel G is to move in the direction of the centering axis C (advancing movement V in FIG. 2), but does not do this (blocking of the axis X of advance). Accordingly, at this time instant the processing force component $F_P$ opposing the advance force $F_V$ is at least equal to the advance force $F_V$ (cf. FIG. 1), in which case the grinding wheel G is prevented from further advancing movement V thereof. The cause of that can be, for example, a blunted or worn grinding wheel G or an insufficient cooling lubricant feed.

The second-mentioned difference case (e) can arise when grinding of a non-circular geometry of the workpiece L is carried out if the processing force component $F_P$ exceeds the advance force $F_V$, since—due to change of the point of action in dependence on angle—variations in amount and effective direction of the grinding force arise, in which case the workpiece L urges away the grinding wheel G against the advancing direction as a consequence of the non-circular external profile AK of the workpiece L. This is illustrated in FIG. 4: the rotating workpiece L pushes, by its radius—which changes over the circumference—with respect to the centering axis C or by its profile sections "jutting out" in radial direction, the grinding wheel G to the right against the advance direction in FIG. 4 by an amount Δx.

In the described difference cases there is a risk of overstressing or overloading of workpiece L and/or tool G, which can lead to "burning" at the point of action and in the case of non-circular processing additionally the risk of "digging in" of the grinding wheel G into the workpiece L and thus of errors in shape at the workpiece L. In order, in these cases, to facilitate yielding of the axis X of advance and also to eliminate the associated initial breakaway torque of the linear guides 30, 32 the force limit of the axis X of advance is dynamically reduced by way of the actuator current I.

More precisely, in the comparison of the determined actual movement direction $R_{ist(n)}$ of the advancing movement V with the determined target movement direction $R_{soll(n)}$ of the advancing movement V there is generated at the summation point 60 a comparison signal which produces a current reduction signal $I_{red(n)}$ by way of a transfer element 62 with proportional-integral action (PI element). Alternatively, use can also be made here of a fast PID element with, for example, a differential or derivative action time $T_V$ of zero or almost zero, which acts similarly to a PI controller.

The current reduction signal $I_{red(n)}$ is applied as a subtrahend to a further summation point 64. The predetermined current limit forms the minuend at the summation point 64, i.e. a signal for a maximum target current $I_{sollmax}$, which arises via a further proportionally acting transfer element 66 (P element) from the maximum target advance force $F_{Vsollmax}$ which has already been mentioned above and which is preset by the NC control. In this preset for the maximum target advance force $F_{Vsollmax}$ (for example 100 N) on the one hand there is consideration of the advance force which is desired for the actual grinding process and which can be input by the user; on the one hand, the force fluctuations of the adjusting axis X due to the influence of cogging torques of the linear motor 34 as well as force losses due to friction in the linear guides 30, 32 and at the covers (not shown) of the work area are taken into consideration, which are determined on a single occasion in exemplifying form and included as an additive value in the target advance force $F_{Vsollmax}$.

The summation point 64 ultimately issues a current limitation signal $I_{max(n)}$ (maximum target current $I_{sollmax}$ minus the respective current reduction $I_{red(n)}$), which is applied to the current controller 48. As a result, the actuator current I, which determines the advance force $F_V$ of the linear motor 34, delivered by the current controller 48 to the linear motor 34 is dynamically limited to the current $I_{max(n)}$, i.e. notwithstanding a possibly present higher current preset $I_{soll(n)}$) in the position control circuit 40 the current controller 48 delivers merely the limited current $I_{max(n)}$ to the linear motor 34. In the above movement direction difference cases (d) and (e) this leads to a reduction in the advance force $F_{V(n)}$ of the linear motor 34 (illustrated by force arrows of different length for the advance force $F_V$ in FIG. 4 at the top right and bottom right). Thereagainst, in the above cases (a) to (c), in which still no difference of the actual and target movement directions of the advancing movement V is present, the predetermined current limit, i.e. the maximum target current $I_{sollmax}$, is not reduced, since the summation point 60 outputs zero and consequently also the current reduction signal $I_{red(n)}$ is zero.

If a movement direction difference according to the cases (d) and (e) is present over several control cycles n then the current reduction signal $I_{red(n)}$ is correspondingly increased by way of the PI element 62; after the summation point 64 the permitted current $I_{max(n)}$ is consequently ever smaller from control cycle to control cycle. The control behavior of the PI element 62—such as fast, "hard" or "soft"—can, as known, in that case be influenced by way of the parameters for the proportional component (amplification $K_P$) and the integral component (reset time $T_N$) and also optimized with respect to the processed material. Advantageously, different parameter sets for the amplification $K_P$ and the reset time $T_N$ are used from grinding process to grinding process in dependence on the circularity or the polygonality of the workpiece geometry to be ground, but then continuously for the respective grinding process. Thus, for a polygonal, for example square, external profile AK the amplification $K_P$ is preselected to be quite high, but the reset time $T_N$ rather small, and for a round or cornerless, for example elliptical, external profile AK the amplification $K_P$ is preselected to be rather lower and consequently the reset time $P_N$ to have a tendency to higher. The actual values for the controller parameterization are to be individually optimized for the respective centering machine 10 and respective grinding process, so that a quantification shall not take place here. If, ultimately, in the comparison of the actual and target movement directions there is no longer a difference at the summation point 60 the actuator current I is increased by way of the current controller 48 back to at most the preset current limit $I_{sollmax}$, whereby the advance force $F_V$ of the linear motor 34 correspondingly increases again.

FIG. 5 shows—recorded over time t in a diagram by way of example for a centered grinding process with the afore-described selectably switchable-on or switchable-off actuator current limitation or force limitation at the linear motor 34—at the top the advance travel x (solid or dotted line) of the X slide 28, consequently of the workpiece spindle 24 together with the grinding wheel G, and below that the lag error (dot-dashed line) building up due to the limitation of the actuator current I. The X slide 28 starts off at the point a at a preselected speed of advance, which does not have to be coupled to the machining capability of the tool and with respect to the most rapid and efficient material machining possible is preferably selected to be higher than possible by material removal by grinding. At the point b the grinding wheel G impinges on the workpiece L. Whereas the actual position $x_{ist}$ follows the target position $x_{soll}$ substantially free of error up to the point b, the actual position $x_{ist}$ (solid line) and target position $x_{soll}$ (dotted line) thereafter "come apart"; a lag error (dot-dashed line at the bottom) arises. In that case, a brief blockage of the advancing movement V is to be expected at the point b (not visible in the graph), which as described above induces a reduction of the advance force $F_V$ by way of the current limitation 42, so that overloading of workpiece L or tool G does not take place. As a consequence, the position control circuit 40 "strives" to compensate for the lag error, but notwithstanding an appropriate current preset $I_{soll}$ at the current controller 48 the supply of current to the linear motor 34 is limited by the current limitation 42 ($I_{max}$). Only from the point c, when the end value of the target position $x_{soll}$ is reached, does the lag error diminish until the actual position $x_{ist}$ has also reached its end value at the point d. In other words, between the points b and d the actual positions $x_{ist}$ of the grinding wheel G and the speed of the advancing movement V (gradient of the graph) come about merely as a consequence of the advance force $F_V$ permitted by way of the current limitation 42. The advance force is of such magnitude between the points b and d as a consequence of the current limitation 42 that a more lengthy deviation between the actual movement direction $R_{ist}$ and the target movement direction $R_{soll}$ of the advancing movement V does not arise, thus will always be a maximum amount within the scope permitted. The described power grinding process can be concluded when at d a settable limit value for the lag error (for example 0.01 mm) is fallen below during a complete revolution of the workpiece L.

Whereas (inter alia) at the point b in FIG. 5 the difference case (d) described further above is expected to be present (blocking of the axis X of advance), the detail $D_V$, which is of substantially increased scale in x direction and t direction, in FIG. 5 illustrates the situation in the difference case (e), which was explained above with reference to FIG. 4, when the rotating workpiece L pushes away the grinding wheel G against the direction of advance by an amount Δx. In that case, the point e in the detail $D_V$ corresponds with the state in FIG. 4 at the top, whereas the point f in the detail $D_V$ represents the state in FIG. 4 at the bottom. Accordingly, increases in the lag error which are repetitive in sawtooth-like manner (not repeatedly illustrated) arise.

When the current limitation 42 is activated the amount of the preselected speed of advance is basically equal, because the target actuator current $I_{soll}$ delivered by the speed controller 46 may in any case be limited ($I_{max}$) in the current controller 48 during the processing. Thus, processing is also possible with different preselected speeds of advance, for example with a rapid movement towards fast approach of tool G and workpiece L and a working cycle, which is slower by comparison therewith, during the machining. The switchover point between fast motion and working cycle can in that case be found simply and reliably by continuous evaluation of the lag error of the axis X of advance (recognition of initial cut), because at the instant of contact between tool G and workpiece L the lag error of the axis X of advance increases rapidly and strongly due to the absence of force reserve or limited advance force $F_V$ of the linear motor 34 (cf. the lag error rapidly building up after the point b in FIG. 5). A safety spacing from the workpiece L, which is usual in the prior art and which is accompanied by a substantial loss of time due to "grinding in mid-air in the working cycle", is not necessary, since as a consequence of the force reduction of the linear motor 34 a critical overloading or destruction of the tool G and/or workpiece L cannot occur.

A method particularly for centered grinding of workpieces such as optical lenses by a grinding tool with use of an actuator for producing a relative advancing movement between grinding tool and workpiece is disclosed, wherein the actuator together with a current controller for an actuator current, which determines an advance force of the actuator, is integrated in a position control circuit, which is run through at a predetermined control cycle. In the case of the method, for each control cycle: (i) a target movement direction of the advancing movement as well as an actual movement direction of the advancing movement are determined; then (ii) the determined actual and target movement directions are compared with one another; and finally (iii) if the comparison shows a difference between the actual and target movement directions a predetermined current limit for the actuator current delivered by way of the current controller is reduced in defined manner in order to reduce the advance force of the actuator. As a result, the advancing movement and material machining are carried out quickly and efficiently without overloading of tool or workpiece being able to occur.

Variations and modifications are possible without departing from the scope and spirit of the present invention as defined by the appended claims.

The invention claimed is:

1. A method of grinding a workpiece, by a grinding tool with use of an actuator for producing a relative advancing movement between said grinding tool and said workpiece, wherein the actuator together with a controller for an actuator current, which determines an advance force of the actuator, is integrated in a position control circuit which is run through with a predetermined control cycle, wherein for each control cycle:

(i) a target movement direction ($R_{soll(n)}$=−1, 0 or 1) of the advancing movement as well as an actual movement direction ($R_{ist(n)}$=−1, 0 or 1) of the advancing movement are determined;

(ii) the determined actual movement direction ($R_{ist(n)}$) of the advancing movement is then compared with the determined target movement direction ($R_{soll(n)}$) of the advancing movement; and (iii) if the comparison gives a difference between the actual movement direction ($R_{ist(n)}$) of the advancing movement and the target movement direction ($R_{soll(n)}$) of the advancing movement a predetermined current limit ($I_{sollmax}$) for the actuator current ($I_{(n)}$) delivered by way of the current controller is subject to defined reduction in order to reduce the advance force of the actuator.

2. A method according to claim 1, wherein for determination of the movement directions ($R_{ist(n)}$; $R_{soll(n)}$) of the advancing movement (V) in step (i) the target and actual positions ($x_{soll(n)}$, $x_{soll(n-1)}$; $X_{ist(n)}$, $x_{ist(n-1)}$) of the actuator are evaluated from the present control cycle and from the preceding control cycle.

3. A method according to claim 2, wherein for the comparison of the determined actual movement direction ($R_{ist(n)}$) of the advancing movement with the determined target movement direction ($R_{soll(n)}$) of the advancing movement in the step (ii) a comparison signal is generated which produces a current reduction signal ($I_{red(n)}$) by way of a PI or PID transfer element and wherein in the step (iii) a signal for the predetermined current limit ($I_{sollmax}$) reduced by the respective current reduction signal ($I_{red(n)}$) is applied as current limitation signal ($I_{max(n)}$) to the current controller.

4. A method according to claim 3, wherein different parameter sets for the proportional component (amplification $K_P$) and the integral component (reset time $T_N$) of the PI or PID transfer element are used depending on the shape of the workpiece to be ground.

5. A method according to claim 4, wherein a linear motor is used as said actuator for producing the relative advancing movement between said grinding tool and said workpiece.

6. A method according to claim 3, wherein a linear motor is used as said actuator for producing the relative advancing movement between said grinding tool and said workpiece.

7. A method according to claim 2, wherein a linear motor is used as said actuator for producing the relative advancing movement between said grinding tool and said workpiece.

8. A method according to claim 1, wherein a linear motor is used as said actuator for producing the relative advancing movement between said grinding tool and said workpiece.

9. A method according to claim 1, wherein for the comparison of the determined actual movement direction ($R_{ist(n)}$) of the advancing movement with the determined target movement direction ($R_{soll(n)}$) of the advancing movement in the step (ii) a comparison signal is generated which produces a current reduction signal ($I_{red(n)}$) by way of a PI or PID transfer element and wherein in the step (iii) a signal for the predetermined current limit ($I_{sollmax}$) reduced by the respective current reduction signal ($I_{red(n)}$) is applied as current limitation signal ($I_{max(n)}$) to the current controller.

10. A method according to claim 9, wherein different parameter sets for the proportional component (amplification $K_P$) and the integral component (reset time $T_N$) of the PI or PID transfer element are used depending on the shape of the workpiece to be ground.

11. A method according to claim 10, wherein a linear motor is used as said actuator for producing the relative advancing movement between said grinding tool and said workpiece.

12. A method according to claim 9, wherein a linear motor is used as said actuator for producing the relative advancing movement between said grinding tool and said workpiece.

* * * * *